US010502504B2

(12) United States Patent
Shin et al.

(10) Patent No.: US 10,502,504 B2
(45) Date of Patent: Dec. 10, 2019

(54) HEAT EXCHANGER AND COUPLING METHOD OF CONNECTING PART THEREOF

(71) Applicant: Hanon Systems, Daejeon (KR)

(72) Inventors: Sung Hong Shin, Daejeon (KR); Sun An Jeong, Daejeon (KR)

(73) Assignee: Hanon Systems, Daejeon (KR)

( * ) Notice: Subject to any disclaimer, the term of this patent is extended or adjusted under 35 U.S.C. 154(b) by 142 days.

(21) Appl. No.: 15/634,036

(22) Filed: Jun. 27, 2017

(65) Prior Publication Data

US 2018/0010865 A1 Jan. 11, 2018

(30) Foreign Application Priority Data

Jul. 6, 2016 (KR) ..... 10-2016-0085416

(51) Int. Cl.
*F28F 9/18* (2006.01)
*F28D 1/053* (2006.01)
*F28F 9/02* (2006.01)

(52) U.S. Cl.
CPC ..... *F28F 9/185* (2013.01); *F28D 1/05366* (2013.01); *F28F 9/0243* (2013.01); *F28F 2275/122* (2013.01)

(58) Field of Classification Search
CPC ..... F28F 9/185; F28F 9/013; F28F 9/0243; F28F 2275/045; F28F 2275/122; F28F 9/0251; F28F 2009/0297; F28F 2225/08; F28F 2275/08; F28F 2275/125; F28D 1/05366
USPC ..... 228/173.1; 72/347, 354.6, 358
See application file for complete search history.

(56) References Cited

U.S. PATENT DOCUMENTS 5,240,068 A * 8/1993 Tokutake ..... B60K 11/04 165/153
5,366,008 A * 11/1994 Kadle ..... F28D 1/05366 165/173
5,432,989 A * 7/1995 Turek ..... B21D 39/031 29/243.5
6,422,302 B1 * 7/2002 Hubert ..... B21D 39/031 165/67

FOREIGN PATENT DOCUMENTS

KR 10-2005-0090290 A 9/2005

* cited by examiner

*Primary Examiner* — Jianying C Atkisson
*Assistant Examiner* — Jose O Class-Quinones
(74) *Attorney, Agent, or Firm* — Norton Rose Fulbright US LLP

(57) ABSTRACT

A heat exchanger in which a connecting part may be coupled to a header tank of the heat exchanger in the short term without using a separate coupling component before a brazing process is performed, and a coupling method of a connecting part thereof. The connecting part is coupled to a first header tank or a second header tank while surrounding a predetermined region of an outer peripheral surface of the first header tank or the second header tank, a region of the connecting part to which external force is locally applied being coupled to the first header tank or the second header tank while protruding together with the first header tank or the second header tank.

5 Claims, 6 Drawing Sheets

HEAT EXCHANGER AND COUPLING METHOD OF CONNECTING PART THEREOF

CROSS-REFERENCE TO RELATED APPLICATIONS

This application claims priority under 35 U.S.C. § 119 to Korean Patent Application No. 10-2016-0085416, filed on Jul. 6, 2016 in the Korean Intellectual Property Office, the disclosure of which is incorporated herein by reference in its entirety.

TECHNICAL FIELD OF THE INVENTION

The following disclosure relates to a heat exchanger and a coupling method of a connecting part thereof. More particularly, the following disclosure relates to a heat exchanger in which a connecting part may be coupled to a header tank of the heat exchanger in the short term without using a separate coupling component before a brazing process is performed, and a coupling method of a connecting part thereof.

BACKGROUND OF THE INVENTION

Generally, an engine room of a vehicle is provided with not only components for driving, such as an engine, and the like, but also various heat exchangers such as a radiator, an intercooler, an evaporator, a condenser, and the like, for cooling the respective components in the vehicle, such as the engine, and the like, or adjusting an air temperature of the interior of the vehicle.

A heat exchange medium generally flows inside the heat exchangers as described above, and the heat exchange medium inside the heat exchangers and air outside the heat exchangers exchange heat with each other, such that cooling or heat dissipation is performed.

Therefore, external air should be smoothly supplied into the engine room of the vehicle in order for the various heat exchangers in the engine room of the vehicle to be stably operated.

Hereinafter, the heat exchangers provided in order to cool the components of the vehicle or the interior of the vehicle as described above are generally called a cooling module.

The radiator, which is a device cooling a coolant having a temperature rising while passing through the engine, generally includes a pair of header tanks, tubes, and fins.

The condenser 10 is a component included in a refrigerant cycle of an air conditioning device, and a refrigerant in a high-temperature and high-pressure gas state is introduced into the condenser 10, is condensed in a liquid state while discharging heat of liquefaction by heat exchange, and is then exhausted.

The condenser 10 includes a pair of header tanks 11 spaced apart from each other by a predetermined distance in a length direction and disposed in parallel with each other; inlet pipes into which the refrigerant is introduced and outlet pipes through which the refrigerant is exhausted; tubes 12 having both ends fixed to the pair of header tanks 11 to form refrigerant channels; and fins 13 interposed between the tubes 12.

In this case, the condenser includes connecting parts coupled to the header tanks so as to be assembled integrally with the radiator, and an example of the condenser is illustrated in FIGS. 1 and 2.

As the related art, Korean Patent Application No. 10-2004-0015637 (filed on Mar. 8, 2004 and entitled 'Component Assembly Attaching Structure and Attaching Process of Header Pipe Using Rivetting') discloses a structure of fixing a component such as connecting parts 14, or the like, to header pipes installed in the condenser by rivetting.

As in the related art, in the condenser, generally, in order to couple and fix the connecting parts to the header tanks, the connecting parts 14 are temporarily assembled using vertical rivets 15, and brazing welding is then performed.

However, in the condenser, in order to temporarily assemble the connecting parts by the rivets, rivet holes should be drilled in the connecting parts, and rivet components are added, such that a cost is increased, and in the case in which the brazing of the connecting parts is defective, a quality problem in which a refrigerant flowing in the condenser is leaked through the rivet holes may occur.

SUMMARY OF THE INVENTION

An embodiment of the present invention is directed to providing a heat exchanger in which a connecting part may be coupled to a header tank of the heat exchanger in the short term without using a separate coupling component before a brazing process is performed, and a coupling method of a connecting part thereof.

In one general aspect, a heat exchanger includes: a first header tank 110 and a second header tank 120 spaced apart from each other by a predetermined distance and disposed in parallel with each other; tubes 200 having both ends fixed to the first header tank and the second header tank 120 and having a heat exchange medium flowing therein; fins 300 interposed between the tubes 200; and a connecting part 400 coupled to the first header tank 110 or the second header tank 120 while surrounding a predetermined region of an outer peripheral surface of the first header tank 110 or the second header tank 120, a region of the connecting part 400 to which external force is locally applied being coupled to the first header tank 110 or the second header tank 120 while protruding together with the first header tank 110 or the second header tank 120.

The connecting part 400 may include: a contact coupling part 410 surrounding the predetermined region of the outer peripheral surface of the first header tank 110 or the second header tank 120; and a component coupling part 420 extending from a partial region of the contact coupling part 410 in an outward direction and coupled to a separate component neighboring to the heat exchanger 1.

The connecting part 400 may include a flat part 430 formed by making a partial region of the contact coupling part flat 410.

The flat part 430 may have a thickness greater than or equal to those of the other regions of the contact coupling part 410.

The external force may be applied to the flat part 430 in a direction from an inner side of the first header tank 110 or the second header tank 120 to which the connecting part 400 is coupled toward an outer side thereof, and the first header tank 110 or the second header tank 120 and the flat part 430 may protrude toward the connecting part 400, such that a protrusion coupling part 440 is formed.

The protrusion coupling part 440 may have a reverse gradient 450 formed at an outer edge of a region in which the first header tank 110 or the second header tank 120 protrudes toward the connecting part 400, such that the protrusion coupling part 440 is coupled and fixed into a protruding region of the flat part 430.

In another general aspect, a coupling method of the connecting part of the heat exchanger described above includes: a connecting part aligning step (S100) of disposing the connecting part 400 at a portion that is to be coupled to the first header tank 110 or the second header tank 120; a punch aligning step (S200) of disposing a punch 500 on a region coupled to a flat part 430, of an inner surface of the first header tank 110 or the second header tank 120 and disposing a die 600 on an outer surface of the flat part 430 of a position corresponding to the punch 500; a pressing step (S300) of applying the external force to the connecting part 400 by the punch 500 to push the first header tank 110 or the second header tank 120 and the flat part 430 into the die 600; and a disassembling step (S400) of separating the punch 500 and the die 600.

The die 600 may include a hollow part 610 formed by depressing an inner edge region of the die 600 at a depth deeper than that of a central region of the die 600.

After the disassembling step (S400), a brazing process may be performed, such that the connecting part 400 is brazing-coupled to the first header tank 110 or the second header tank 120.

DETAILED DESCRIPTION OF MAIN ELEMENTS

| | |
|---|---|
| 1: heat exchanger | |
| 110: first header tank | 120: second header tank |
| 131: header | 132: tank |
| 200: tube | |
| 300: fin | |
| 400: connecting part | |
| 410: contact coupling part | 420: component coupling part |
| 430: flat part | 440: protrusion coupling part |
| 450: reverse gradient | |
| 500: punch | |
| 600: die | 610: hollow part |
| S100~S400: respective steps of coupling method of connecting part | |

DETAILED DESCRIPTION OF EMBODIMENTS

Hereinafter, a heat exchanger and a coupling method of a connecting part thereof according to the present invention will be described in detail with reference to the accompanying drawings.

Figure 1:
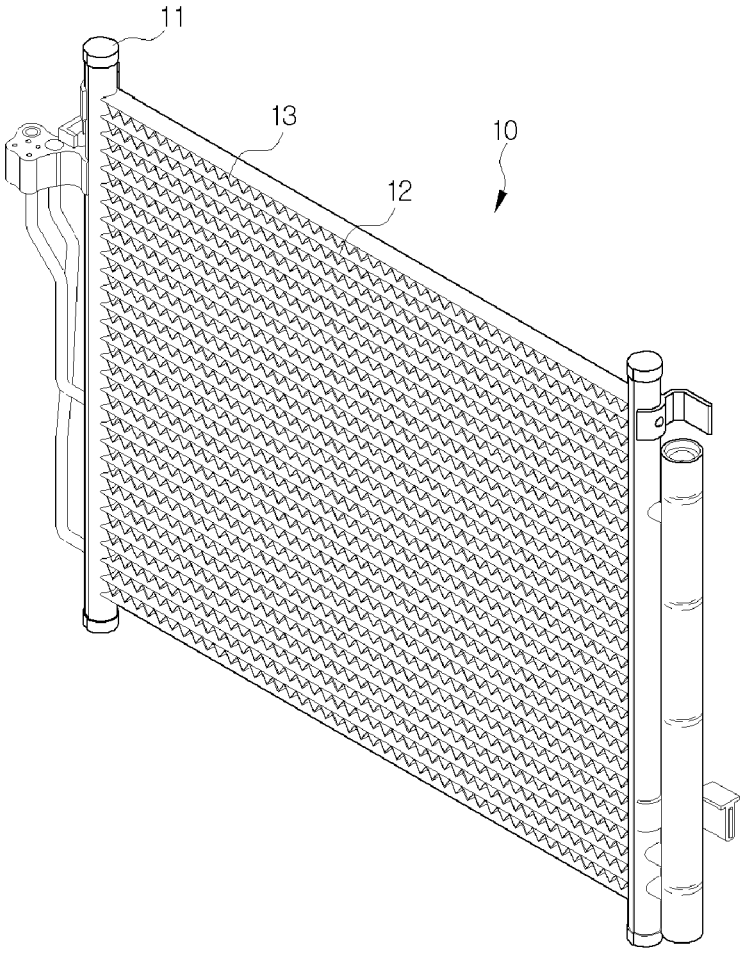
FIG. 1 is a perspective view illustrating a heat exchanger according to the related art.
Figure 2:
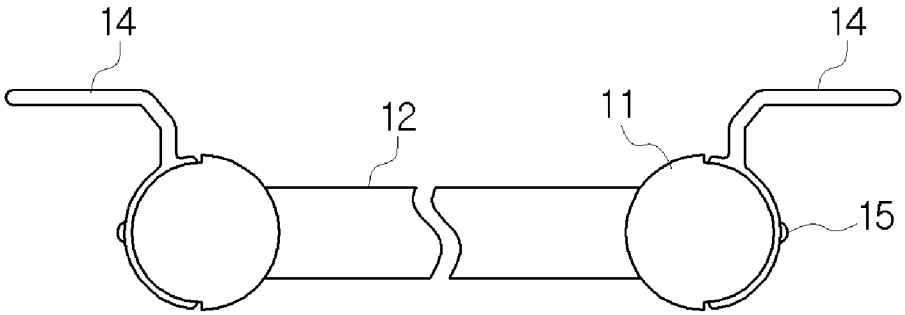
FIG. 2 is a plan view illustrating the heat exchanger of FIG. 1.
Figure 3:
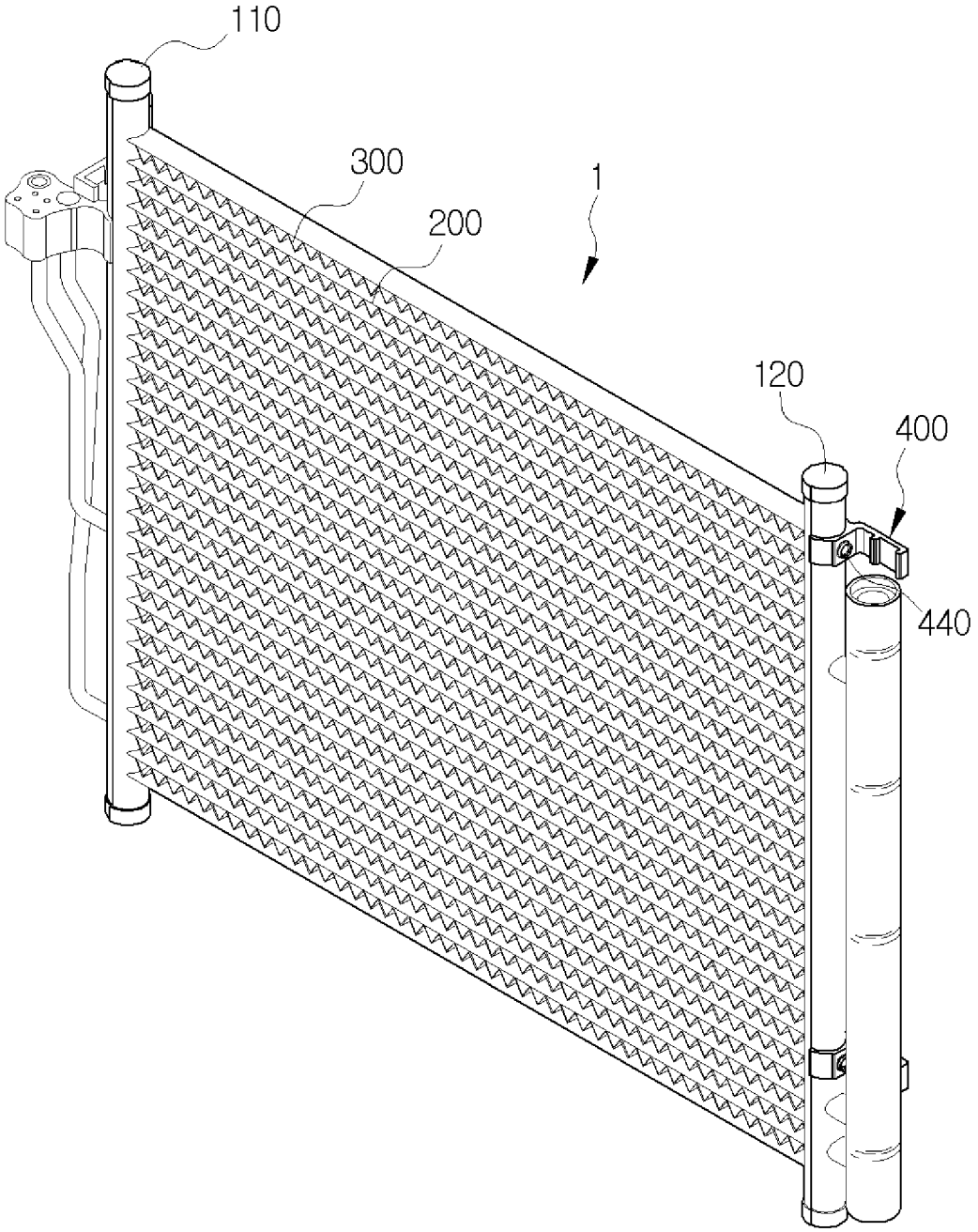
FIG. 3 is a perspective view illustrating a heat exchanger according to the present invention.
Figure 4:
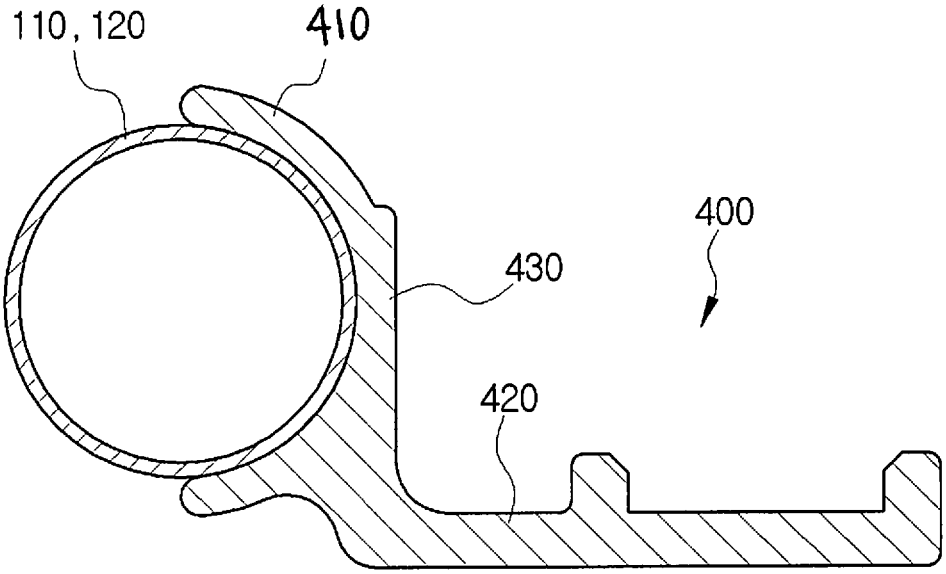
FIG. 4 is a cross-sectional view illustrating a state before a connecting part is coupled in the heat exchanger according to the present invention.
Figure 5:
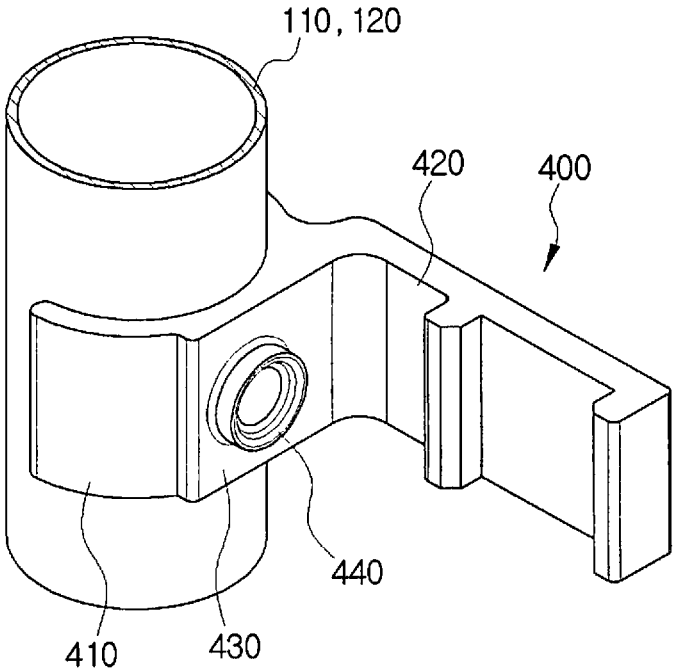
FIG. 5 is a partially perspective view illustrating a portion to which the connecting part is coupled in the heat exchanger according to the present invention.
Figure 6:
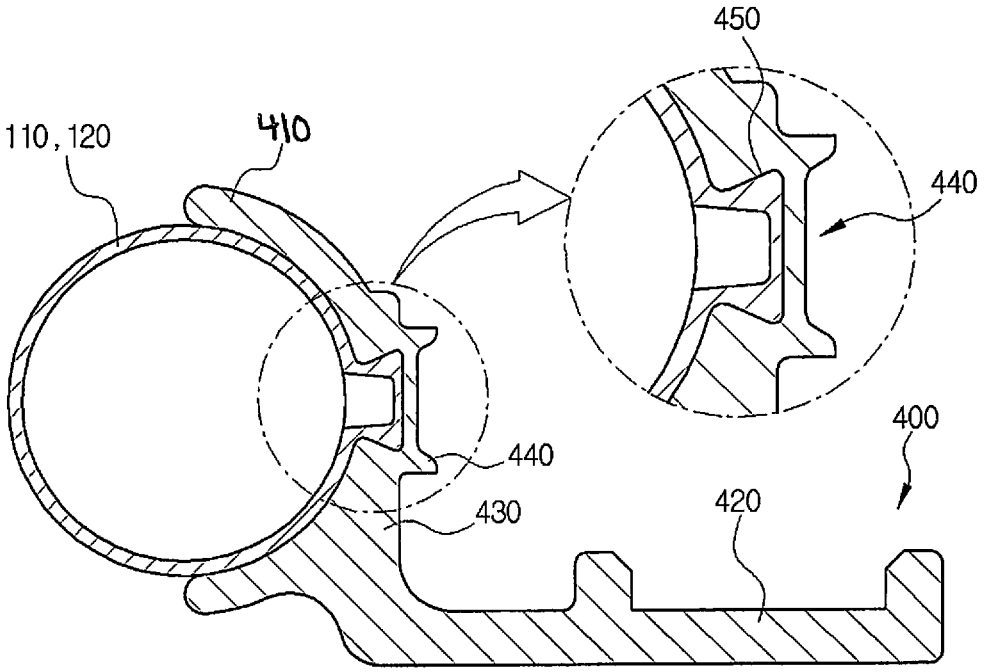
FIG. 6 is a cross-sectional view illustrating a state after the connecting part is coupled in the heat exchanger according to the present invention.
Figure 7:
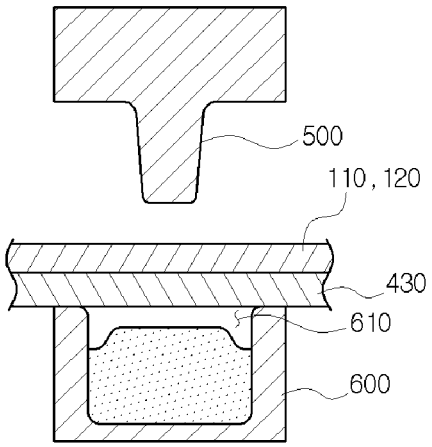
FIGS. 7 to 9 are views sequentially illustrating a coupling method of a connecting part of a heat exchanger according to the present invention.
Figure 8:
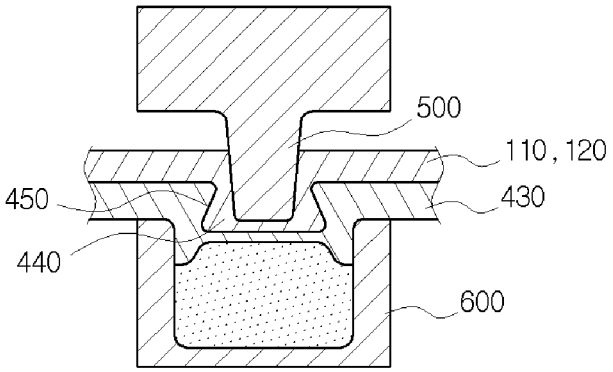
Figure 9:
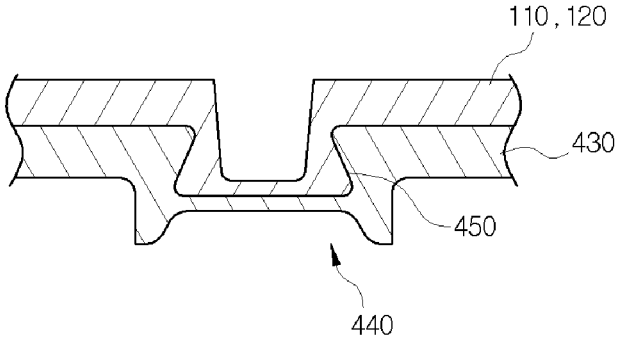
Figure 10:
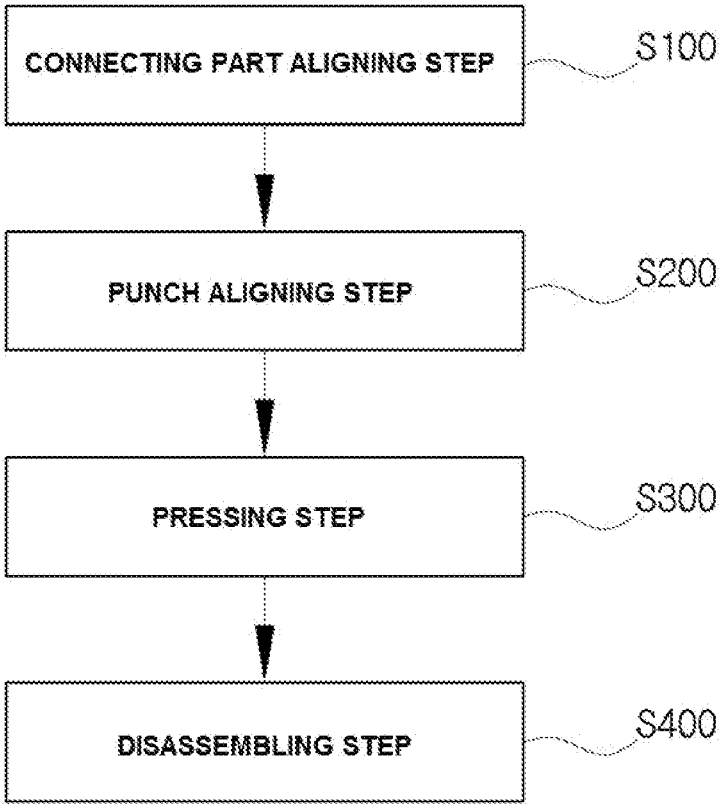
FIG. 10 is a flow chart illustrating the coupling method of a connecting part of a heat exchanger according to the present invention.

FIG. 3 is a perspective view illustrating a heat exchanger according to the present invention, FIG. 4 is a cross-sectional view illustrating a state before a connecting part is coupled in the heat exchanger according to the present invention, FIG. 5 is a partially perspective view illustrating a portion to which the connecting part is coupled in the heat exchanger according to the present invention, FIG. 6 is a cross-sectional view illustrating a state after the connecting part is coupled in the heat exchanger according to the present invention, FIGS. 7 to 9 are views sequentially illustrating a coupling method of a connecting part of a heat exchanger according to the present invention, and FIG. 10 is a flow chart illustrating the coupling method of a connecting part of a heat exchanger according to the present invention.

As illustrated in FIGS. 3 and 4, a heat exchanger 1 according to an exemplary embodiment of the present invention mainly includes a first header tank 110 and a second header tank 120 spaced apart from each other by a predetermined distance and disposed in parallel with each other, tubes 200, fins 300 interposed between the tubes 200, and a connecting part 400.

The heat exchanger 1 illustrated in FIGS. 3 and 4 includes the first header tank 110 and the second header tank 120 spaced apart from each other by the predetermined distance in a length direction and formed in parallel with each other, and the first header tank 110 and the second header tank 120 are formed by assembly between a header 131 and a tank 132.

The heat exchanger 1 may be a cross flow type heat exchanger as illustrated in FIGS. 3 and 4 or be a down flow type heat exchanger.

In addition, the heat exchanger 1 further includes inlet pipes into which a heat exchange medium is introduced and outlet pipes through which a heat exchange medium is exhausted, the inlet pipes and the outlet pipes being formed in a pair of first header tanks 110 or second header tanks 120.

Here, the heat exchanger 1 may be a condenser or be another heat exchanger 1 such as a radiator, an evaporator, an intercooler, or the like.

The tubes 200 have both ends fixed to the first header tank 110 and the second header tank 120 to form channels of the heat exchange medium, and are spaced apart from each other by a predetermined interval in a height direction and are disposed in parallel with each other.

The fins 300 are interposed between the tubes 200 to increase heat transfer areas with air flowing between the tubes 200, and may be formed in a corrugate type vertically bent so that heat transfer areas as large as possible are provided in predetermined spaces between the tubes 200.

As described above, the fins 300 are interposed between the tubes 200 to allow heat exchange between the heat exchange medium and the air to be performed due to a heat transfer phenomenon by conduction generated in regions in which the fins 300 are in contact with the tubes 200.

Next, the connecting part 400 is coupled to the first header tank 110 or the second header tank 120 while surrounding a predetermined region of an outer peripheral surface of the first header tank 110 or the second header tank 120, may be a radiator in the case in which a neighboring separate component, that is, the heat exchanger 1 is the condenser, and serves as a coupling member for coupling to another neighboring component such as a carrier, a fan shroud, an internal heat exchanger 1, or the like.

Generally, the connecting part 400 is temporarily assembled to the first header tank 110 or the second header tank 120 and is then completely coupled to the first header tank 110 or the second header tank 120 through brazing. However, in the heat exchanger 1 according to an exemplary embodiment of the present invention, external force is locally applied to a coupled portion in order to temporarily assemble the connecting part 400, and the first header tank 110 or the second header tank 120 at the portion to which the external force is applied and the connecting part 400 are coupled to each other while protruding together with each other.

A structure of the connecting part 400 will be first described with reference to the drawings. The connecting part 400 mainly includes a contact coupling part 410 and a component coupling part 420.

The contact coupling part 410, which a part coupled to the heat exchanger 1 according to an exemplary embodiment of the present invention, is coupled to the first header tank 110 or the second header tank 120 while surrounding the predetermined region of the outer peripheral surface of the first header tank 110 or the second header tank 120.

The component coupling part 420, which is a part coupled to a separate component neighboring to the heat exchanger 1 according to an exemplary embodiment of the present invention, extends from a partial region of the contact coupling part 410 in an outward direction toward the component, and a form of the component coupling part 420 may be variously modified depending on a form, a position, and the like, of the component to which the component coupling part 420 is coupled.

Particularly, it is preferable that a partial region of the contact coupling part 410 of the connecting part 400 is formed to be flat in order to increase coupling force.

In a coupling process, the first header tank 110 or the second header tank 120 protruding by external force of a punch 500 and a die 600 into which the connecting part 400 is pushed are disposed outside the flat part 430, and the flat part 430 is formed to be flat, such that the die 600 may be disposed to be closely adhered to the flat part 430.

In this case, it is preferable that the flat part 430 is formed at a thickness greater than or equal to those of the other regions of the contact coupling part 410.

The reason is that thicknesses of the flat part 430 protruding by the external force of the punch 500 and a tank 132 of the first header tank 110 or the second header tank 120 in contact with the flat part 430 can not but become thin while the flat part 430 and the tank 132 are expanded for protrusion.

Therefore, in the present invention, the flat part 430 is formed at a thickness greater than those of the other regions, such that the flat part 430 is maintained at a predetermined thickness or more even after it protrudes, thereby making it possible to prevent a decrease in durability.

As described above, in the heat exchanger 1 according to the present invention, when the connecting part 400 is coupled to the first header tank 110 or the second header tank 120, the partial region protrudes by the external force applied to the flat part 430, such that the connecting part 400 is coupled to the first header tank 110 or the second header tank 120.

More accurately, in the heat exchanger 1, the external force is applied to the flat part 430 in a direction from an inner side of the first header tank 110 or the second header tank 120 to which the connecting part 400 is coupled toward an outer side thereof, and the first header tank 110 or the second header tank 120 and the flat part 430 protrude toward the connecting part 400, such that a protrusion coupling part 440 is formed.

That is, the protrusion coupling part 440 indicates a region in which the first header tank 110 or the second header tank 120 and the flat part 430 protrude together with each other outwardly by the external force of the punch 500.

In this case, the protrusion coupling part 440 has a reverse gradient 450 formed at an outer edge of a region in which the first header tank 110 or the second header tank 120 protrudes toward the connecting part 400, such that it may be coupled and fixed into a protruding region of the flat part 430.

A side surface of the protrusion coupling part 440 adjacent to the connecting part 400 is formed in a form corresponding to that of a hollow part 610 of the die 600, and as illustrated in FIG. 7, the hollow part 610 is formed by depressing an inner edge region of the die 600 at a depth deeper than that of a central region of the die 600, thereby allowing an edge of an outer surface of the protrusion coupling part 440 to further protrude outwardly as compared with the other regions.

In other words, an edge of the protrusion coupling part 440 adjacent to the connecting part 400 further protrudes outwardly so that the protrusion coupling part 440 corresponds to the form of the hollow part 610, such that the reverse gradient 450 may be formed at an edge of a protruding region of the first header tank 110 or the second header tank 120. Through this, the connecting part 400 may be temporarily assembled to the heat exchanger 1.

Next, a coupling method of a connecting part of a heat exchanger according to an exemplary embodiment of the present invention will be described with reference to FIGS. 7 to 10. The coupling method of a connecting part mainly includes a connecting part aligning step (S100), a punch aligning step (S200), a pressing step (S300), and a disassembling step (S400).

First, the connecting part aligning step (S100) is a step of disposing the connecting part 400 at a portion that is to be coupled to the first header tank 110 or the second header tank 120.

It is preferable that a punch 500 and a die 600 to be described below are disposed on a straight line in a vertical direction and the punch 500 applies pressure from the top toward the bottom. In this case, the connecting part 400 is disposed at a lower side, and the tank 132 of the first header tank 110 or the second header tank 120 may be disposed to be in contact with an upper surface of the connecting part 400.

Then, in the punch aligning step (S200), the punch 500 is disposed on an inner surface of the tank 132 coupled to the flat part 430, and the die 600 is disposed on an outer surface of a position corresponding to the punch 500, that is, a lower surface of the flat part 430 of the connecting part 400.

Then, the punch 500 moves downwardly to press the tank 132, and a surface of the tank 132 is pushed together with the flat part 430 of the position corresponding to the punch 500 into the die 600.

In this process, the outer surface of the flat part 430 is formed so that an edge thereof protrudes in a form corresponding to that of the hollow part 610 of the die 600, and the reverse gradient 450 is formed at an outer edge of the tank 132 in contact with the flat part 430, such that the protrusion coupling part 440 may be formed. Then, the punch 500 and the die 600 are separated.

In the coupling method of a connecting part of a heat exchanger as described above, after the disassembling step (S400), the connecting part 400 may be coupled and fixed to the first header tank 110 or the second header tank 120 by brazing through a brazing process of the heat exchanger 1.

Therefore, in the heat exchanger 1 according to an exemplary embodiment of the present invention, the connecting part 400 may be coupled to the header tank in the short term without using a separate coupling component before the brazing process is performed, such that the numbers of processes and components may be reduced.

Therefore, in the heat exchanger according to an exemplary embodiment of the present invention, the connecting part may be coupled to the header tank in the short term without using a separate coupling component before the brazing process is performed, such that the numbers of processes and components may be reduced.

That is, as compared with the heat exchanger according to the related art in which the connecting part is temporarily assembled using the rivet, in the present invention, an additional component such as the rivet is not used, such that a cost may be reduced, a rivet hole does not need to be drilled, such that an assembling time may be reduced, and the rivet hole is not present, such that a problem in which a refrigerant is leaked in the case in which brazing is defective may be prevented.

In addition, in the heat exchanger according to an exemplary embodiment of the present invention, a part protruding by the external force of the punch is formed at a thickness greater than those of the other regions, thereby making it possible to prevent the decrease in the durability due to a decrease in the thickness of the protruding part.

Further, in the heat exchanger according to an exemplary embodiment of the present invention, a region in which the punch and the die are disposed is formed to be flat, such that coupling force may be increased as compared with a case in which the region is a curved surface.

The present invention is not limited to the abovementioned exemplary embodiments, but may be variously applied. In addition, the present invention may be variously modified by those skilled in the art to which the present invention pertains without departing from the gist of the present invention claimed in the claims.

What is claimed is:

1. A heat exchanger comprising:

a first header tank and a second header tank spaced apart from each other by a predetermined distance and disposed in parallel with each other;

tubes having two ends respectively fixed to the first header tank and the second header tank and having a heat exchange medium flowing therein;

fins interposed between the tubes; and a connecting part coupled to the first header tank or the second header tank wherein the connecting part comprises:

a contact coupling part surrounding a predetermined region of the outer peripheral surface of the first header tank or the second header tank to which the connecting part is coupled;

a component coupling part extending from a partial region of the contact coupling part in an outward direction relative to the first header tank or the second header tank to which the connecting part is coupled, the component coupling part coupled to a separate component neighboring to the heat exchanger;

a flat part located at a partial region of the contact coupling part, the flat part having a thickness greater than a thickness of all remaining portions of the contact coupling part; and a protrusion coupling part formed on a portion of the flat part and on a portion of the first header tank or the second header tank to which the connecting part is coupled, the protrusion coupling part extending in a direction from an inner side of the first header tank or the second header tank to which the connecting part is coupled toward an outer side of the first header tank or the second header tank to which the connecting part is coupled, such that the portion of the first header tank or the second header tank to which the connecting part is coupled and the portion of the flat part protrude together toward the outside of the first header tank or the second header tank to which the connecting part is coupled.

2. The heat exchanger of claim 1, wherein the protrusion coupling part has a reverse gradient formed at an outer edge of a region in which the first header tank or the second header tank protrudes toward the the outside of the first header tank or the second header tank to which the connecting part is coupled, such that the protrusion coupling part is coupled and fixed into a protruding region of the flat part.

3. A coupling method of the connecting part of the heat exchanger of claim 1, comprising:

a connecting part aligning step of disposing the connecting part at a portion that is to be coupled to the first header tank or the second header tank;

a punch aligning step of disposing a punch on a region at an inner surface of the first header tank or the second header tank coupled to the flat part, and disposing a die on an outer surface of the flat part at a position corresponding to the punch;

a pressing step of applying an external force to the connecting part by the punch to push the first header tank or the second header tank and the flat part into the die; and a disassembling step of separating the punch and the die.

4. The coupling method of the connecting part of the heat exchanger of claim 3, wherein the die includes a hollow part having an inner edge region which is deeper than that of a central region of the hollow part.

5. The coupling method of the connecting part of the heat exchanger of claim 3, wherein after the disassembling step, a brazing process is performed, such that the connecting part is brazed-coupled to the first header tank or the second header tank.

* * * * *